United States Patent [19]

Quinn, Jr. et al.

[11] Patent Number: 5,009,093

[45] Date of Patent: Apr. 23, 1991

[54] APPARATUS AND METHOD FOR ROLL FORMING AND MARKING SHEET METAL

[76] Inventors: F. Dillard Quinn, Jr., 775 Beech Valley Rd.; Anthony W. Quinn, 3611 Briar Dr., both of Lithia Springs, Ga. 30057

[21] Appl. No.: 610,337

[22] Filed: Nov. 5, 1990

Related U.S. Application Data

[63] Continuation of Ser. No. 424,730, Oct. 20, 1989, abandoned.

[51] Int. Cl.[5] ..... B21D 35/00

[52] U.S. Cl. ..... 72/177; 72/188

[58] Field of Search ..... 72/177, 188, 196; 101/6, 23

[56] References Cited

U.S. PATENT DOCUMENTS

| | | | |
|---|---|---|---|
| 737,291 | 8/1903 | Smyth | 72/71 |
| 1,551,863 | 9/1925 | Berry | 52/737 |
| 2,639,660 | 5/1953 | Sunderhauf et al. | 72/196 |
| 3,509,753 | 5/1970 | Orth | 72/196 |
| 4,130,974 | 12/1978 | Chalmers et al. | 72/177 |
| 4,267,954 | 5/1981 | Smith | 72/196 |
| 4,343,171 | 8/1982 | Kagawa | 72/177 |
| 4,725,111 | 2/1988 | Weitzen . | |

FOREIGN PATENT DOCUMENTS

| | | |
|---|---|---|
| 764-774 | 9/1980 | U.S.S.R. . |
| 764-775 | 9/1980 | U.S.S.R. . |

*Primary Examiner*—Lowell A. Larson

*Attorney, Agent, or Firm*—Jones, Askew & Lunsford

[57] ABSTRACT

Method and apparatus for roll forming and marking sheet metal. Sheet metal is embossed with an identifying relief pattern as the sheet metal moves through the nip between first and second forming rollers of a roll-forming machine. More particularly, sheet metal is embossed with first and second embossing rollers juxtaposed so that there is a nip therebetween. Sheet metal moves through the nip between the first and second embossing rollers as the sheet metal moves through the nip between first and second forming rollers. Sheet metal products are easily and economically marked with permanent identifying relief patterns.

3 Claims, 3 Drawing Sheets

APPARATUS AND METHOD FOR ROLL FORMING AND MARKING SHEET METAL

This is a continuation of application Ser. No. 07/424,730, filed Oct. 20, 1989, now abandoned.

TECHNICAL FIELD

This invention relates generally to the roll forming of sheet metal, and more particularly to the marking of roll-formed sheet metal with information such as manufacturer and size.

BACKGROUND OF THE INVENTION

Roll forming is a well-known method for making useful articles from sheet metal. Roll forming is commonly used to make pipes for such uses as heating and air conditioning ducts, fittings for pipes, and flanges.

Conventional roll-forming machines generally include at least one pair of juxtaposed forming rollers. To roll form sheet metal with convention roll-forming machines, the forming rollers are rotated and a piece of sheet metal is fed between the forming rollers so that the sheet metal is drawn through the nip between the forming rollers. The forming rollers are configured to impart a shape to the sheet metal drawn therebetween by bending or folding the sheet metal. Conventional roll-forming machines often include a multitude of pairs of such forming rollers positioned in series. With these larger more complicated roll-forming machines, the sheet metal is generally fed through the nip between the first pair of forming rollers so that the sheet metal is then drawn through the entire series of forming rollers.

After production, roll-formed sheet metal products are normally marked to indicate the manufacturer and size thereof. Size marking is necessary for manufacturers, wholesalers, and retailers to keep track of inventory, and for end users to select the correct size of sheet metal product and corresponding fittings.

One conventional method of marking sheet metal products is ink marking. The manufacturer and size of the sheet metal product is simply marked on the surface of the sheet metal product with ink. This method of marking is unsatisfactory for the following reasons. First, the ink tends to smear and rub off easily during handling of the sheet metal product. In addition, ink marking of sheet metal products requires an additional labor step after the production of the sheet metal product which increases the cost of the sheet metal product.

Another conventional method of marking sheet metal products is packing the sheet metal products in appropriately-marked boxes. This method of marking is also unsatisfactory because of the additional expense of the labeled box and the additional labor step required after the production of the sheet metal product. In addition, once the sheet metal product is taken out of the box, the sheet metal product is no longer easily identified.

Still another method of marking sheet metal products is bundling sheet metal products of the same size and tying the bundle together with a strap which indicates the manufacturer and size of the sheet metal products in the bundle. This method of marking sheet metal products is also unsatisfactory because of the additional expense of the marking strap and the additional labor step required to bundle and strap the sheet metal products after production. In addition, as with the method of boxing the sheet metal products, the sheet metal products are not easily identified after the sheet metal products are unbundled.

Therefore, there is a need for a method of permanently marking roll-formed sheet metal products which is also cost effective.

SUMMARY OF THE INVENTION

An object of the present invention is to provide a method and apparatus for improved roll forming and marking of sheet metal.

Another object of the present invention is to provide a method and apparatus for permanent marking of roll-formed sheet metal.

A further object of the present invention is to provide a method and apparatus for more economical marking of roll-formed sheet metal products.

The present invention fulfills these and other objects by providing a first forming roller and a second forming roller, the first and second forming rollers juxtaposed so that there is a nip therebetween, moving the sheet metal through the nip between the first and second forming rollers, and embossing the sheet metal with an identifying relief pattern as the sheet metal moves through the nip between the first and second forming rollers.

More specifically, the present invention embosses sheet metal by providing a first embossing roller and a second embossing roller, the first and second embossing rollers juxtaposed so that there is a nip therebetween, and moving the sheet metal through the nip between the first and second embossing rollers as the sheet metal moves through the nip between the first and second forming rollers.

Still more specifically, the first embossing roller provided by the present invention has a relief pattern extending outwardly therefrom, the relief pattern including at least a portion of the identifying relief pattern, and the second embossing roller provided by the present invention has an engraved pattern for receiving the relief pattern of the first embossing roller, the engraved pattern being substantially identical to the relief pattern of the first embossing roller. In this embodiment, the sheet metal is embossed with the relief pattern of the first embossing roller as the sheet metal moves through the nip between the first and second embossing rollers.

Even more specifically, the present invention provides for removably attaching a first interchangeable embossing plate to the first embossing roller before the sheet metal is moved through the nips between the first and second embossing rollers and the first and second forming rollers, and removably attaching a second interchangeable embossing plate to the second embossing roller before moving the sheet metal through the nips between the first and second embossing rollers and the first and second forming rollers. This allows the identifying relief pattern with which the sheet metal is embossed to be changed for each new piece of sheet metal which is roll formed. More specifically, in this embodiment of the present invention, the first embossing roller has a recess in its outer surface for removably receiving the first embossing plate, and the second embossing roller also has a recess in its outer surface for removably receiving the second embossing plate.

Still more specifically, the present invention provides a first shaft coupled with both the first forming roller and the first embossing roller, and a second shaft coupled with both the second forming roller and the second embossing roller. By rotating the first second shafts, the first and second forming rollers and the first and second embossing rollers are rotated so as to draw sheet metal through the nips between the first and second forming rollers and the first and second embossing rollers.

By embossing sheet metal products, the sheet metal products can be permanently marked with an identifying pattern such as the name of the manufacturer and the part size. Because the marking is permanent and is on the sheet metal product itself, it is not necessary to further mark the sheet metal product with ink or straps, or by putting the sheet metal product in a marked box. In addition, the present invention provides for the marking of sheet metal products during the roll-forming process, and thus no additional labor step is required for marking. Therefore, in the long run, the marking of roll-formed sheet metal products with the present invention is less expensive than with conventional methods of marking.

Other objects, features, and advantges of the present invention will become more readily apparent from the following detailed description, drawings and claims.

DETAILED DESCRIPTION

Figure 1:
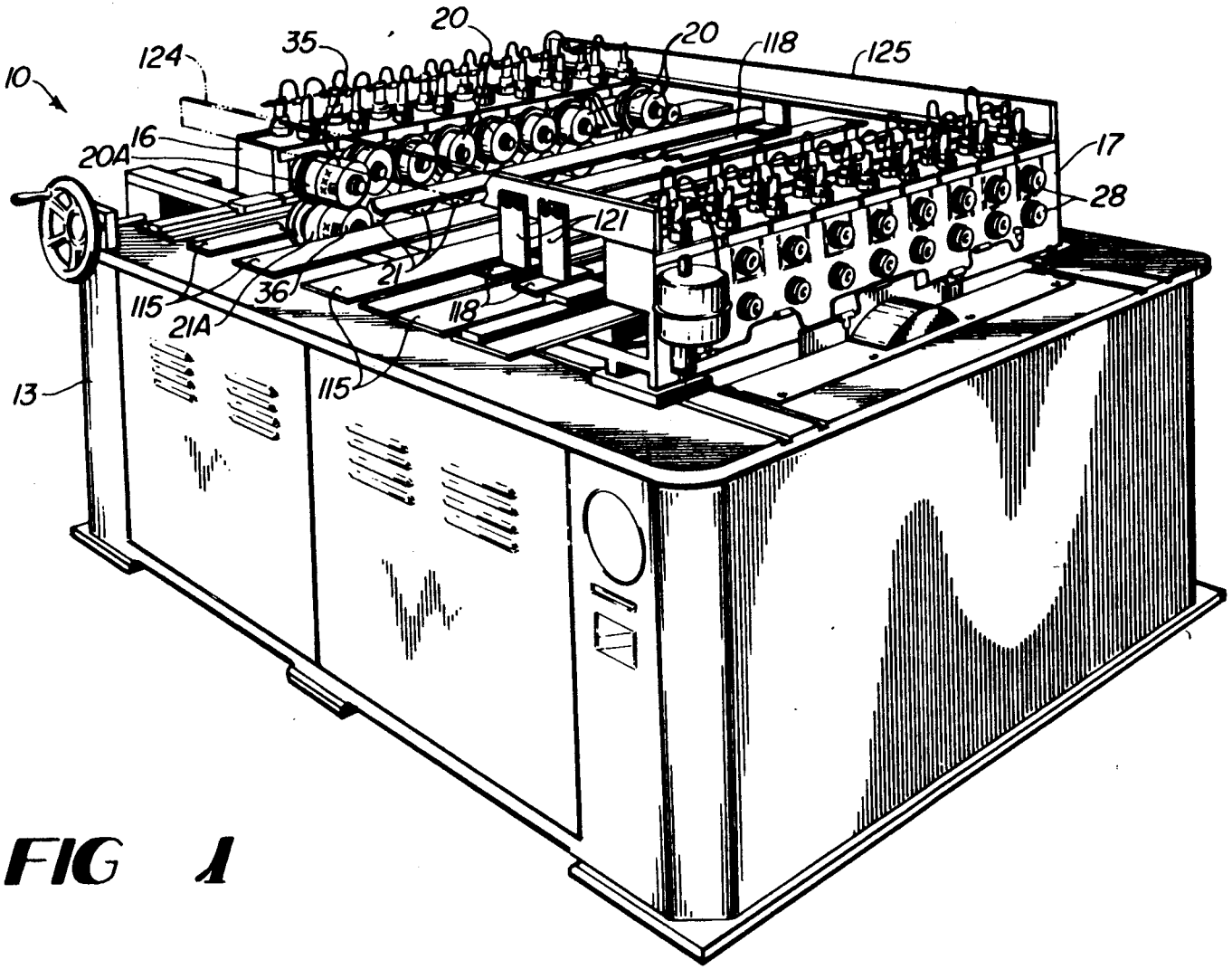
FIG. 1 is a perspective view of a roll-forming pipe line machine according to a preferred embodiment of the present invention.

Turning first to FIG. 1, a roll-forming pipe line machine 10 according to a preferred embodiment of the present invention is shown. The roll-forming pipe line machine 10 comprises a box-shaped base 13 and roller support frames 16 and 17 positioned along opposite sides of the base. First and second forming rollers 20 and 21 extend inwardly from each of the roller support frames 16 and 17. Each first forming roller 20 is positioned juxtapositional to a corresponding second forming roller 21 so that there is a nip between each first forming roller and the corresponding second forming roller. The first and second forming rollers 20 and 21 are positioned along both of the roller support frames 16 and 17 so that the nips between the first and second forming rollers are aligned. Each of the first and second forming rollers 20 and 21 are mounted with first and second shafts (not shown) respectively, which extend through the first and second forming rollers and fit into hubs 28 in the roller support frames 16 and 17.

As best shown in FIGS. 2–6, juxtaposed first and second forming rollers 20A and 21A are mounted with extended first and second shafts 24 and 25, respectively. A first embossing roller 35 is fitted onto the extended first shaft 24 against the first forming roller 20A, and a second embossing roller 36 is fitted onto the extended second shaft 25 against the second forming roller 21A. Like the first and second forming rollers 20A and 21A, the first and second embossing rollers 35 and 36 are juxtaposed so that there is a nip 37 therebetween.

The extended first shaft 24 includes a journal portion 39 which fits into one of the hubs 28 in the roller support frame 16. The journal portion 39 extends from the rearward end 40 of the extended first shaft 24 to a cylindrical stop 42 with extending outwardly from the midsection of the extended first shaft. The extended first shaft 24 also includes a cylindrical forward portion 45 which extends from the cylindrical stop 42 to the forward end 47 of the extended first shaft. An elongated channel 50 extends into the extended first shaft 24 along the cylindrical forward portion 45. The extended first shaft 24 has a threaded bore 52 in the forward end 47.

Figure 2:
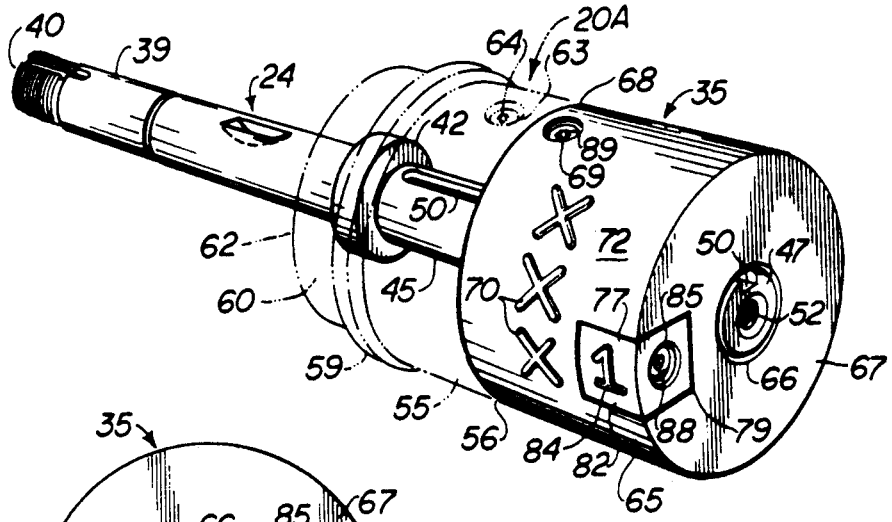
FIG. 2 is a perspective view of the first embossing roller and the first forming roller shown in FIG. 1.

The first forming roller 20A is shown best in FIGS. 2 (in phantom lines) and 6 and includes a cylindrical forward portion 55 which extends from a forward end 56 to a cylindrical ring 59 which extends outwardly from the first forming roller. A cylindrical rearward portion 60 having a diameter less than that of the cylindrical forward portion 55 extends from the cylindrical ring 59 to the rearward end 62 of the first forming roller 20A. A concentric bore extends through the first forming roller 20A from the forward end 56 to the rearward end 62. A threaded bore 63 extends through the forward portion 55 of the first forming roller 20A to the cylindrical bore. The first forming roller 20A fits onto the cylindrical forward portion 45 of the first extended shaft 24 against the cylindrical stop 42. The concentric bore of the first forming roller 20A receives the forward portion of 45 of the extended first shaft 24, and a bolt 64 extends through the threaded bore 63 into the elongated channel 50 so as to lock the first forming roller onto the extended first shaft.

Figure 3:
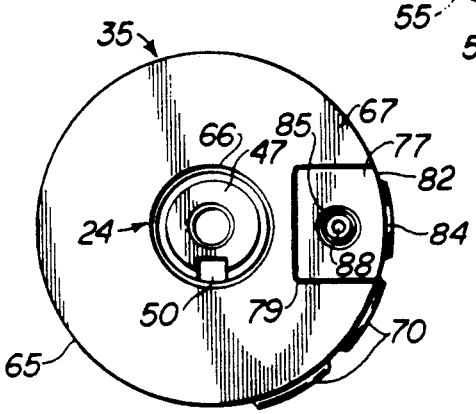
FIG. 3 is an end elevation view of the first embossing roller shown in FIG. 1.

The first embossing roller 35 is best shown in FIGS. 2 and 3 and includes a cylindrical body 65 with a concentric bore 66 which extends from the forward end 67 to the rearward end 68 of the cylindrical body. A threaded bore 69 extends through the cylindrical body 65 from the outer surface 72 of the cylindrical body to the concentric bore 66. A relief pattern 70 extends outwardly from the outer surface 72 of the first embossing roller 35. The relief pattern 70 is shown as a series of X's; however, any relief pattern suitable for identification purposes may be used.

A first interchangeable embossing plate 77 fits into a U-shaped recess 79 in the outer surface 72 of the cylindrical body 65. The first interchangeable embossing plate 77 has an arcuate outwardly-facing surface 82 which is flush with the outer surface 72 of the first embossing roller 35 except for a relief pattern 84 extending outwardly from the first interchangeable embossing plate. A threaded bore 85 extends through the first interchangeable embossing plate 77 and is aligned with a threaded bore (not shown) in the cylindrical body 65 of the first embossing roller 35. A bolt 88 fits through the threaded bore 85 and into the threaded bore in the cylindrical body 65, and fastens the first interchangeable embossing plate 77 to the cylindrical body 65 of the first embossing roller 35.

The first embossing roller 35 fits onto the forward portion 45 of the extended first shaft 24 against the first forming roller 20A. The concentric bore 66 of the first embossing roller 35 receives the forward portion 45 of the extended first shaft 24, and a bolt 89 extends through the threaded bore 69 into the elongated channel 50 of the forward portion of the extended first shaft so as to couple the first embossing roller to the extended first shaft. The first embossing roller 35 and the first forming roller 20A are held onto the forward portion 45 of the extended first shaft 24 with a washer 90 and a bolt 92 (shown in FIG. 6) which fits into the threaded bore 52 in the forward end 47 of the extended first shaft.

Figure 4:
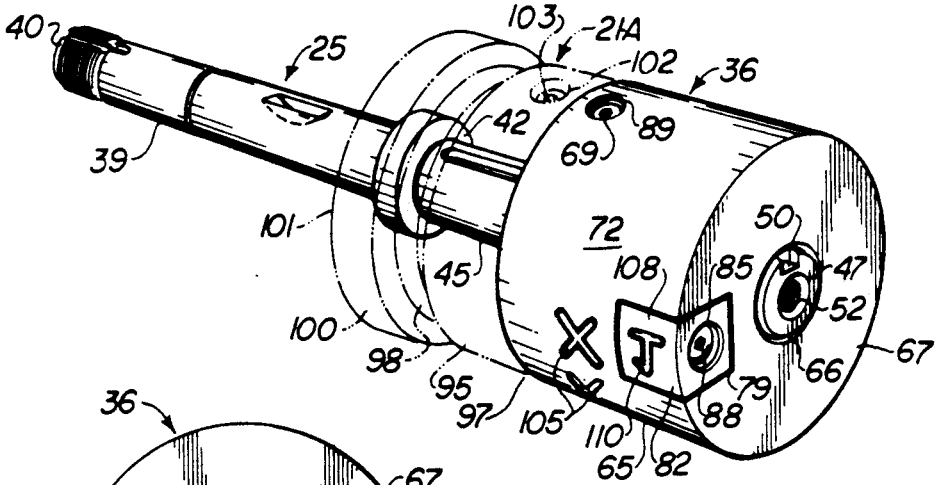
FIG. 4 is a perspective view of the second embossing roller and the second forming roller shown in FIG. 1.
Figure 5:
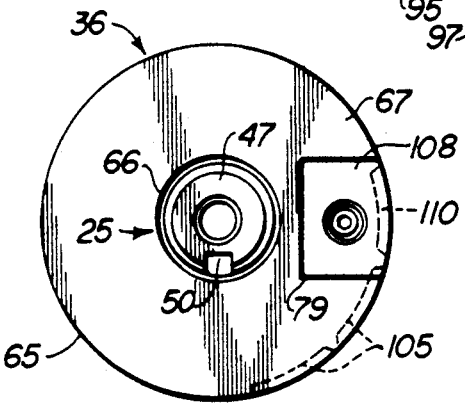
FIG. 5 is an end elevation view of the second forming roller shown in FIG. 1.
Figure 6:
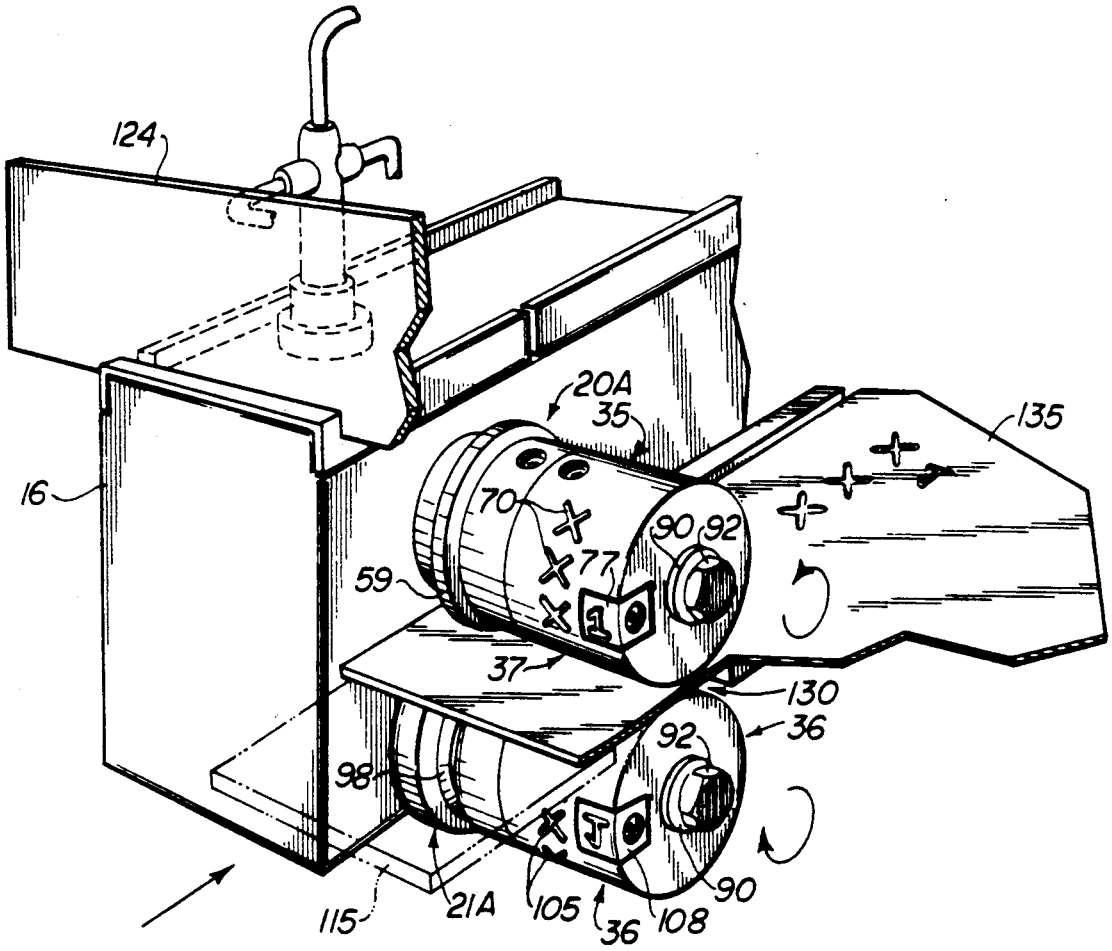
FIG. 6 is a partial perspective view of the roll-forming pipe line machine shown in FIG. 1 illustrating the first and second embossing rollers.

The extended second shaft 25 is best shown in FIG. 4 and is identical to the extended first shaft. Accordingly, the same numerals reference like parts on both the extended first shaft 24 and the extended second shaft 25.

The second forming roller 21A includes a cylindrical forward portion 95 which extends from a forward end 97 to an indented portion 98 configured to receive the cylindrical ring 59 of the first forming roller 20A. A cylindrical rearward portion 100 extends from the indented portion 98 to a rearward end 101 and extends outwardly beyond the cylindrical portion 95. A concentric bore extends from the forward end 97 to the rearward end 101 of the second forming roller 21A. A threaded bore 102 extends through the forward portion 95 of the second forming roller 21A to the cylindrical bore. The second forming roller 21A fits onto the cylindrical forward portion 45 of the extended second shaft 25 in the same manner the first forming roller 20A fits over the forward portion of the extended first shaft 24. A bolt 103 extends through the threaded bore 102 into the elongated channel 50 of the extended second shaft 25 so as to lock the first forming roller onto the extended second shaft.

The second embossing roller 36 is identical to the first embossing roller 35 except that the second embossing roller has an engraved pattern 105 instead of a relief pattern. The engraved pattern 105 is identical to the relief pattern 70 of the first embossing roller 35 and receives the relief pattern of the first embossing roller during operation of the roll-forming pipe line machine 10. Because of the similarity of the first and second embossing rollers 35 and 36, the same numerals are used in FIGS. 2 and 4 to reference like parts.

The U-shaped recess 79 of the second embossing roller 36 receives a second interchangeable embossing plate 108 which is the same as the first interchangeable embossing plate 77 except that the second interchangeable embossing plate has an engraved pattern 110 instead of a relief pattern. The engraved pattern 110 of the second interchangeable embossing plate is the same as the relief pattern 84 of the first interchangeable embossing plate 77. The engraved pattern 110 of the second interchangeable embossing plate 108 receives the relief pattern 84 of the first interchangeable embossing plate 77 during operation of the roll-forming pipe line machine 10.

The second embossing roller 36 is locked onto the forward portion 45 of the extended second shaft 25 in the same manner that the first embossing roller 35 is locked onto the forward portion of the extended first shaft 24. The second forming roller 21A and the second embossing roller 36 are held onto the extended second shaft 25 with a washer 90 and head bolt 92 which fits into the threaded bore 52 in the forward end 47 of the extended second shaft.

The roll-forming pipe line machine 10 also includes a plurality of lower guide plates 115 positioned between and parallel to the roller support frame 16 and 17. Upper guide plates 118 are positioned above and parallel to the lower guide plates 115 so that there is a gap therebetween. The upper guide plates are suspended by brackets 121 which are mounted onto elongated flanges 124 and 125 extending between the roller support frames 16 and 17. A gap 130 in the lower guide plate 115 adjacent roller frame 16 allows for the first and second embossing rollers 35 and 36.

Before operation of the roll-forming pipe line machine 10, first and second interchangeable embossing plates 77 and 108 are selected for producing a relief pattern which will appropriately mark the sheet metal product to be produced. For example, first and second embossing plates 77 and 108 for producing a relief pattern showing the appropriate size of the sheet metal product to be produced may be selected. The appropriate first and second interchangeable embossing plates are then fastened to the first and second embossing rollers 35 and 36. The relief pattern 70 on the cylindrical body 68 of the first embossing roller 35 can be the name of the manufacturer of the sheet metal product; however, it should be understood that this relief pattern can also be changed by replacing the first and second embossing rollers 35 and 36.

After the appropriate interchangeable embossing plates 77 and 108 have been selected and installed, a piece of sheet metal 135 is fed into the roll-forming pipe line machine 10 so that the sheet metal slides through the space between the upper and lower guide plates 115 and 118, and the leading edge of the sheet metal fits into the nip between the first and second forming rollers 20A and 21, the nip 37 between the first and second embossing rollers 35 and 36, and the nip between the first and second forming rollers 20 and 21 opposite the first and second forming rollers 20A and 21A. The first and second shafts coupled to the first and second forming rollers 20 and 21 and the extended first and second shafts 24A and 25A are then rotated so that the first and second forming rollers 20, 21, 20A and 21A and the first and second embossing rollers 35 and 36 are rotated so as to draw the sheet metal through the nips between the rollers. As the sheet metal is drawn through the nips between the first and second forming rollers 20A and 21A and the first and second embossing rollers 35 and 36, the sheet metal is simultaneously roll formed by the first and second forming rollers and embossed with appropriate identifying information by the first and second embossing rollers.

When it is desired to change the identifying information with which the sheet metal is embossed, the first and second interchangeable embossing plate 77 and 108 are simply replaced with embossing plates having the appropriate pattern.

The roll forming pipe line machine 10 provides for the marking of roll-formed sheet metal products without an additional labor step and without additional materials such as inks, boxes, or straps. Thus, the roll-forming pipe line machine 10 provides for the marking of sheet metal in a manner that is both easy and economical. Further, the roll-forming pipe line machine 10 permanently marks sheet metal products so that the sheet metal product can be properly identified by the manufacturer, the wholesaler, the retailer, and the end user throughout the life of the sheet metal product.

It should be understood that the practice of the present invention is not limited to a pipe line roll-forming machine or any particular type of roll-forming machine. In addition, it should be understood that the practice of the present invention is not limited to roll-forming machines with multiple pairs of forming rollers. It should also be understood that the practice of the present invention is not limited to a roll-forming machine having forming rollers of any particular configuration.

It should further be understood that the foregoing relates only to a preferred embodiment of the present invention, and that numerous changes therein may be made without departing from the spirit and scope of the invention as defined by the following claims.

We claim:

1. Apparatus for roll-forming sheet metal into air duct pipe having a predetermined part size, comprising:

a pair of opposing and substantially parallel roller support frames spaced from one another;

a plurality of first shafts rotatably mounted to and along each of the opposing roller support frames, the plurality of first shafts extending inwardly from each of the opposing roller support frames towards the opposite roller support frame;

a plurality of second shafts rotatably mounted to and along each of the opposing roller support frames, the plurality of second shafts extending inwardly from each of the opposing roller support frames towards the opposite roller support frame, each of the plurality of second shafts positioned juxtapositional to a corresponding first shaft;

a plurality of first forming rollers mounted on corresponding first shafts;

a plurality of second forming rollers mounted on corresponding second shafts, each first forming roller being positioned juxtapositional to a corresponding second forming roller so that there is a nip between each of the juxtaposed first and second forming rollers, the juxtaposed first and second forming rollers forming a pair of opposing roll forming lines;

a first embossing roller mounted on one of said first shafts and extending inwardly from the first forming roller mounted on the one of said first shafts to a substantially exposed forward end, the first embossing roller being separate from the first forming roller mounted on the one of said first shafts, the first embossing roller extending beyond each of the first forming rollers in the associated roll forming line towards the opposing roll forming line, the first embossing roller having an outer surface and a relief pattern extending outwardly therefrom, the relief pattern including an indication of the predetermined part size of the air duct pipe;

a second embossing roller mounted on the second shaft positioned juxtapositional to the one of said first shafts on which the first embossing roller is mounted, the second embossing roller extending inwardly from the second forming roller mounted on the associated second shaft to a substantially exposed forward end, the second embossing roller being separate from the second forming roller on the associated second shaft, the second embossing roller extending beyond each of the second forming rollers in the associated roll forming line towards the opposing roll forming line, the first and second embossing rollers juxtaposed so that there is a nip therebetween, the second embossing roller having an outer surface which has an engraved pattern for receiving the relief pattern, the engraved pattern being substantially identical to the relief pattern; and means for rotating the first and second shafts so as to draw the sheet metal through the nips between the first and second forming rollers and the first and second embossing rollers, whereby the sheet metal is simultaneously roll formed into air duct pipe by the first and second forming rollers and embossed with the identifying relief pattern by the first and second embossing rollers.

2. Apparatus as in claim 1, wherein:

the first embossing roller comprises a first interchangeable embossing plate having an outwardly-facing surface, the outwardly-facing surface having a relief pattern including an indication of the predetermined part size, the first interchangeable embossing plate removably mounted within a recess in the outer surface of the first embossing roller so that the outer surface of the first embossing roller includes the outwardly-facing surface of the first interchangeable embossing plate and the relief pattern of the first embossing roller includes the relief pattern of the first interchangeable embossing plate; and the second embossing roller comprises a second interchangeable embossing plate having an outwardly-facing surface, the outwardly-facing surface having an engraved pattern for receiving the relief pattern of the first interchangeable embossing plate, the engraved pattern of the second interchangeable embossing plate being substantially identical to the relief pattern of the first interchangeable embossing plate, the second interchangeable embossing plate removably mounted within a recess in the outer surface of the second embossing roller so that the outer surface of the second embossing roller includes the outwardly-facing surface of the second interchangeable embossing plate and the engraved pattern of the second embossing roller includes the engraved pattern of the second interchangeable embossing plates.

3. Apparatus as in claim 2, wherein:

the first interchangeable embossing plate has an exposed end and is positioned so that the exposed end of the first embossing roller comprises the exposed end of the first interchangeable embossing plate, the first interchangeable embossing plate being removably mounted within the recess of the first embossing roller by a bolt which extends from the exposed end of the first enterchangeable embossing plate, through the first interchangeable embossing plate and into the first embossing roller, and the second interchangeable embossing plate has an exposed end, the exposed end of the second embossing roller comprising the exposed end of the second interchangeable embossing plate, the second interchangeable embossing plate being removably mounted within the recess of the second embossing roller by a bolt which extends from the exposed end of the second interchangeable embossing plate, through the second interchangeable embossing plate and into the second embossing roller, whereby the first and second interchangeable embossing plates are easily accessible for removal and replacement.

* * * * *